US007280636B2

(12) United States Patent
Morrison et al.

(10) Patent No.: US 7,280,636 B2
(45) Date of Patent: Oct. 9, 2007

(54) DEVICE AND METHOD FOR PRODUCING A SPATIALLY UNIFORMLY INTENSE SOURCE OF X-RAYS

(75) Inventors: Timothy I. Morrison, Darien, IL (US); Ivan Nesch, Crown Point, IN (US); Gocha Khelashvili, Chicago, IL (US)

(73) Assignee: Illinois Institute of Technology, Chicago, IL (US)

( * ) Notice: Subject to any disclaimer, the term of this patent is extended or adjusted under 35 U.S.C. 154(b) by 64 days.

(21) Appl. No.: 10/957,878

(22) Filed: Oct. 4, 2004

(65) Prior Publication Data

US 2005/0117705 A1 Jun. 2, 2005

Related U.S. Application Data

(60) Provisional application No. 60/508,690, filed on Oct. 3, 2003.

(51) Int. Cl.
*H01J 35/00* (2006.01)

(52) U.S. Cl. ..... 378/122; 378/136; 378/143

(58) Field of Classification Search ..... 378/119, 378/121, 122, 143, 136
See application file for complete search history.

(56) References Cited

U.S. PATENT DOCUMENTS

| | | | | |
|---|---|---|---|---|
| 3,919,580 A | | 11/1975 | Mooney et al. | 313/310 |
| 4,126,805 A | | 11/1978 | Randall | 378/137 |
| 4,468,586 A | | 8/1984 | Hohn | 313/336 |
| 4,698,835 A | | 10/1987 | Ono et al. | 378/136 |
| 4,730,353 A | | 3/1988 | Ono et al. | 378/138 |
| 4,777,642 A | | 10/1988 | Ono | 378/138 |
| 5,014,289 A | * | 5/1991 | Rothe | 378/122 |
| 5,044,005 A | | 8/1991 | De Fraguier et al. | 378/136 |
| 5,142,652 A | * | 8/1992 | Reichenberger et al. | 378/136 |
| 5,170,422 A | | 12/1992 | Fiebiger | 378/136 |
| 5,259,014 A | * | 11/1993 | Brettschneider | 378/138 |
| 5,757,115 A | | 5/1998 | Narita et al. | 313/346 R |
| 5,987,095 A | | 11/1999 | Chapman et al. | 378/70 |
| 6,038,285 A | | 3/2000 | Zhong et al. | 378/84 |
| 6,319,188 B1 | * | 11/2001 | Lovoi | 600/3 |

(Continued)

FOREIGN PATENT DOCUMENTS

FR 2844916 A1 * 3/2004

OTHER PUBLICATIONS

J.L. Cronin in *Modern dispenser cathodes, IEE Proc.*, vol. 128, Pt. 1, No. 1, (Feb. 1981).

*Primary Examiner*—Jurie Yun
(74) *Attorney, Agent, or Firm*—Pauley Petersen & Erickson

(57) ABSTRACT

An x-ray source for producing a uniformly intense area x-ray beam. The x-ray source includes a vacuum chamber. An area electron emitter is disposed at a first end of the vacuum chamber. A target material is disposed at a second end of the vacuum chamber and spaced apart from the area electron emitter. The area electron emitter and the target material are correspondingly shaped and/or correspondingly curved. The x-ray source also includes at least one high voltage power source. The area electron emitter is electrically connected to a negative pole of one of the at least one high voltage power source and the target electrically connected to a positive pole of one of the at least one high voltage power source.

12 Claims, 3 Drawing Sheets

U.S. PATENT DOCUMENTS

| | | | | |
|---|---|---|---|---|
| 6,556,656 | B2 | 4/2003 | Hess et al. | 378/136 |
| 6,577,708 | B2 | 6/2003 | Chapman et al. | 378/82 |
| 6,850,598 | B1 * | 2/2005 | Fryda et al. | 378/161 |
| 6,965,662 | B2 * | 11/2005 | Eppler et al. | 378/25 |
| 6,980,627 | B2 * | 12/2005 | Qiu et al. | 378/122 |
| 2002/0009179 | A1 | 1/2002 | Hess et al. | 378/136 |
| 2002/0041140 | A1 | 4/2002 | Rho et al. | 313/346 R |
| 2002/0054664 | A1 | 5/2002 | Tiren | 378/119 |
| 2002/0085674 | A1 | 7/2002 | Price et al. | 378/122 |
| 2002/0125806 | A1 | 9/2002 | Sugimura et al. | 313/346 R |
| 2004/0240616 | A1 * | 12/2004 | Qiu et al. | 378/136 |

* cited by examiner

DEVICE AND METHOD FOR PRODUCING A SPATIALLY UNIFORMLY INTENSE SOURCE OF X-RAYS

CROSS REFERENCE TO RELATED APPLICATION

This application claims priority to U.S. Provisional Application Ser. No. 60/508,690, filed on 3 Oct. 2003. The co-pending U.S. Provisional Application is hereby incorporated by reference herein in its entirety and is made a part hereof, including but not limited to those portions which specifically appear hereinafter.

FIELD OF THE INVENTION

This invention relates to a device and a method for producing an x-ray beam, and, more particularly, a device and a method for producing an extended, two-dimensional, spatially uniformly intense source of x-rays.

BACKGROUND OF THE INVENTION

X-ray imaging has been used in the medical field and for radiology in general, such as non-destructive testing and x-ray computed tomography. Conventional radiography systems use x-ray absorption to distinguish differences between different materials, such as normal and abnormal human tissues.

Current x-ray sources typically incorporate wound filaments or small emitters, such as, for example, tungsten, tungsten alloys, or lanthanum hexaboride structures. An emphasis has been on developing point emitters that generally provide very small sources of electrons, which, in turn, can provide an approximate point source of x-rays. However, current x-ray point sources, particularly wound filament structures, if used to provide larger and, in particular, spatially uniform area x-ray sources, typically do not provide a spatially uniform x-ray emission field, due to artifacts in the uniformity of the emitted field of x-rays, generally resulting from nonuniform electron area impact patterns.

SUMMARY OF THE INVENTION

A general object of the invention is to provide an improved x-ray source. A more specific objective of the invention is to overcome one or more of the problems described above.

It is one object of this invention to provide an x-ray source that produces a spatially uniformly intense source of x-rays.

It is a further object of this invention to provide an x-ray source incorporating a relatively large area electron emitter, as compared to the prior art.

It is yet another object of this invention to provide an x-ray source incorporating a dispenser cathode as an electron emitter.

The general object of the invention can be attained, at least in part, through an x-ray source for producing a uniformly intense area x-ray beam. The x-ray source includes a vacuum chamber. An area electron emitter is disposed at a first end of the vacuum chamber. A target material is disposed at a second end of the vacuum chamber and spaced apart from the area electron emitter. The x-ray source also includes at least one high voltage power source. The area electron emitter is electrically connected to a negative pole of one of the at least one high voltage power source and the target electrically connected to a positive pole of one of the at least one high voltage power source.

In contrast to the present invention, the prior art generally fails to provide or disclose an x-ray source incorporating an area electron emitter. The prior art also generally fails to disclose incorporating correspondingly shaped and/or curved area electron emitters and target materials to produce a spatially uniform intense source of x-rays.

The invention further comprehends an x-ray source for producing a uniformly intense area x-ray beam. The x-ray source includes a vacuum chamber. A dispenser cathode is disposed at a first end of the vacuum chamber. An anode is disposed at a second end of the vacuum chamber and spaced apart from the dispenser cathode. The x-ray source also includes at least one high voltage power source. The dispenser cathode is electrically connected to a negative pole of one of the at least one high voltage power source and the anode electrically connected to a positive pole of one of the at least one high voltage power source.

The invention still further comprehends a method of generating a uniformly intense area x-ray beam. The method includes determining a desired geometry for the uniformly intense area x-ray beam; providing a target material including at least one of a shape and a curve to produce the desired geometry for the uniformly intense area x-ray beam; matching to the shaped target material an area electron emitter having at least one of a corresponding shape and a corresponding curve; emitting electrons from the area electron emitter toward the target material; and impacting the electrons with the target material in a uniform distribution to generate a uniformly intense area x-ray beam.

Other objects and advantages will be apparent to those skilled in the art from the following detailed description taken in conjunction with the appended claims and drawings.

DEFINITIONS

Figure 1:
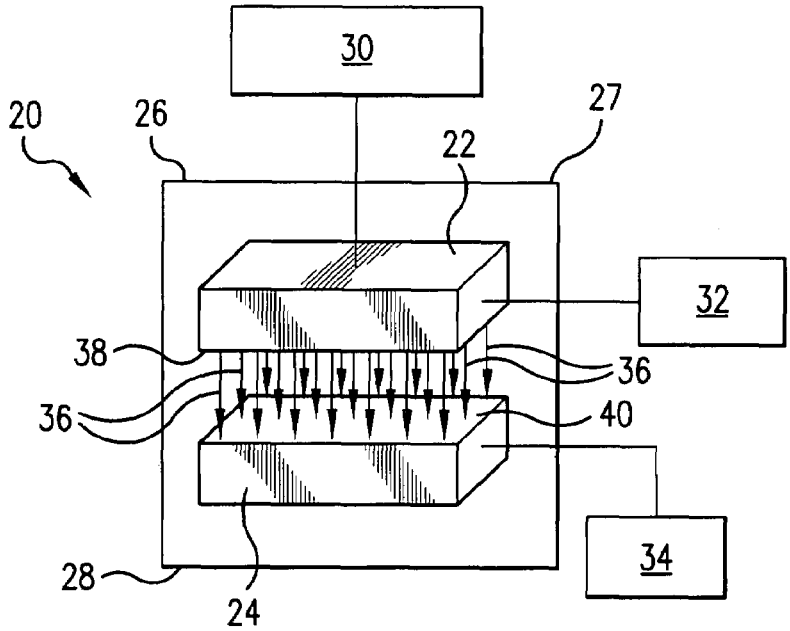
FIG. 1 is a simplified general representation of an x-ray source according to one embodiment of this invention.

Within the context of this specification, each term or phrase below will include the following meaning or meanings.

As used herein, references to "correspondingly shaped" or a "corresponding shape" are to be understood to refer to an area electron emitter, or a surface thereof, and a target material, or a surface thereof, having matching, identical, or substantially identical shapes.

References herein to "correspondingly curved" or a "corresponding curve" are to be understood to refer to an area electron emitter, or a surface thereof, having a curvature in a least one dimension (or along one axis) that corresponds to the curvature of a surface of a target material, or a surface thereof, in the same dimension (or along the same axis) as determined by a Least-Squares fitting method, and vice versa. Generally speaking, a concave surface of an area electron emitter is correspondingly curved to a convex surface of a target material, and vice versa.

References herein to "concave" or "concavolinear" are interchangeable and to be understood to refer to a surface, or the object including the surface, that in concave is a first dimension and linear in a second dimension. "Concave" or "concavolinear" is an opposite and corresponding curve to convex or convexolinear.

References herein to "convex" or "convexolinear" are interchangeable and to be understood to refer to a surface, or the object including the surface, that in convex is a first dimension and linear in a second dimension. "Convex" or "convexolinear" is an opposite and corresponding curve to concave or concavolinear.

References herein to "concavoconcave" are to be understood to refer to a surface, or the object including the surface, that in concave is a first dimension and also concave in a second dimension. "Concavoconcave" is an opposite and corresponding curve to convexoconvex.

References herein to "concavoconvex" are to be understood to refer to a surface, or the object including the surface, that in concave is a first dimension and convex in a second dimension. An opposite and corresponding curve for "concavoconvex" is another concavoconvex curve in which a corresponding surface, or object including the surface, is convex in the first dimension and concave in the second dimension.

References herein to "convexoconvex" are to be understood to refer to a surface, or the object including the surface, that in convex is a first dimension and convex in a second dimension. "Convexoconvex" is an opposite and corresponding curve to concavoconcave.

Further, references herein to "dispenser cathode" are to be understood to generally refer to cathodes including an emitting material impregnated with, or otherwise in combination with, a refractory metal. An example of a dispenser cathode includes porous tungsten impregnated with at least barium oxide. Other dispenser cathodes are disclosed by J. L. Cronin in *Modern dispenser cathodes, IEE Proc.*, Vol. 128, Pt. 1, No. 1, (February 1981), herein incorporated by reference.

These terms may be defined with additional language in the remaining portions of the specification.

DETAILED DESCRIPTION OF THE PRESENTLY PREFERRED EMBODIMENTS

FIG. 1 is a simplified general representation of an x-ray source 20, according to one embodiment of this invention, for producing a uniformly intense area x-ray beam. The x-ray source 20 includes an area electron emitter 22. A target material 24 is aligned with and spaced apart from the electron emitter 22.

The area electron emitter 22 and the target material 24 are disposed within a vacuum chamber 26. The area electron emitter is disposed toward a first end 27 of the vacuum chamber 26 and the target material 24 is disposed toward a second end 28 of the vacuum chamber 26.

The x-ray source 20 includes an electric power source 30 electrically connected to the area electron emitter 22. In one embodiment of this invention, the area electron emitter 22 is connected to both poles the electric power source 30. The electric current from the electric power source 30 is used to heat the area electron emitter 22. As will be appreciated by one skilled in the art following the teachings herein provided, various and alternative means available in the art for heating an area electron emitter, such as, without limitation, indirect heating methods known in the art, are also available for use in the x-ray source of this invention. Heating the area electron emitter 22 causes the area electron emitter 22 to generate and release electrons. The area electron emitter 22 is also connected to the negative pole of a high voltage power source 32 for bias, thus setting up the area electron emitter 22 to higher electrostatic potential than the target material 24.

The x-ray source 20 also includes a second high voltage power source 34. A positive pole of the high voltage power source 34 is electrically connected to the target material 24. As will be appreciated by one skilled in the art following the teachings herein provided, in another embodiment of this invention, the area electron emitter and the target material can be electrically connected to the respective opposite poles of a single high voltage power source. In yet another embodiment of this invention, the target material is connected to an electrical ground instead of being electrically connected to a high voltage power source.

As discussed above, the area electron emitter 22 is heated by an electric current from the electric power source 30 to create and release electrons. By electrically connecting the target material 24 to the positive pole of the second high voltage power source 34, the electrons emitted from the heated area electron emitter 22 are directed toward the target material 24. Arrows 36 illustrate electron trajectories between the area electron emitter 22 and the target material 24. The area electron emitter 22 desirably uniformly emits electrons along most, and more desirably all, of an emitting surface 38.

The area electron emitter 22 desirably includes, or is formed of, a conductive material that, when heated by, for example, an electric current, releases electrons. The area electron emitter 22 of one embodiment of this invention is a cathode. As will be appreciated by one skilled in the art following the teachings herein provided, the area electron emitter or cathode used in the x-ray source of this invention can be formed of various conductive materials known and available in the art for cathodes such as, without limitation, tungsten, a tungsten/rhenium alloy, and combinations thereof.

The x-ray source of this invention, as illustrated in FIG. 1, desirably includes a single cathode as the area electron emitter 22. The single cathode desirably produces a predetermined uniform extraction of electrons. In one particularly preferred embodiment of this invention, the area electron emitter 22 includes a dispenser cathode.

In one embodiment of this invention, the target material 24 is an anode. As will be appreciated by one skilled in the art following the teachings herein provided, the target material 24, or anode, is desirably formed of materials such as are known and available in the art for constructing anodes that release x-rays upon being bombarded with electrons, such as, without limitation, copper, silver, tungsten, and combinations thereof. In one embodiment of this invention, the x-ray source includes a shaped target material, such as, for example, a shaped anode. As shown in FIG. 1, the shaped target material 38 has a rectangular box-shaped configuration.

In one embodiment of this invention, the area electron emitter is correspondingly shaped to the shaped target material, e.g., the shaped anode. As shown in FIG. 1, the area electron emitter 22 has a rectangularly shaped electron emitting surface 38 that is correspondingly shaped to, i.e., correspondingly matches, a rectangular x-ray emitting surface 40 of the target material facing the electron emitting surface 38. Correspondingly matching the shaped electron emitting surface 38 of the area electron emitter 22 and the shaped x-ray emitting surface 40 of the target material 24, provides a uniform electron impact distribution on the x-ray emitting surface 40 and a spatially uniform emission of electrons from the electron emitting surface 38.

The uniform electron impact distribution on the target material 24 creates, provides, or results in an extended, two-dimensional, spatially uniform source of x-rays being emitted from the target material 24. As will be appreciated by one skilled in the art following the teachings herein provided, the desired corresponding shapes of the shaped area electron emitter and the shaped target material according to this invention will depend on the particular need, e.g., the particularly desired geometry of the x-ray beam for the respective x-ray source application. The shaped area electron emitter and the shaped target material, or shaped anode, of this invention can include shaped surfaces such as, for example, a square shaped surface, a rectangular shaped surface, an oval shaped surface, or a polygonal shaped surface.

Figure 2:
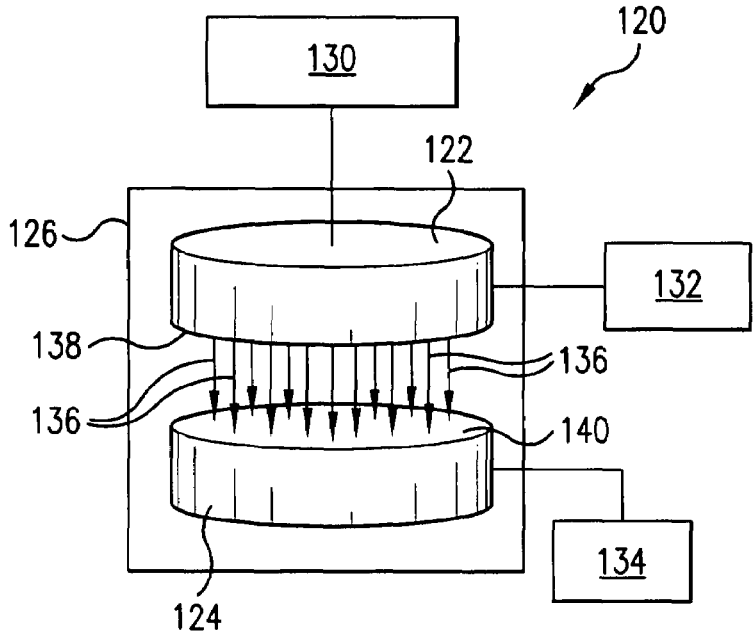
FIG. 2 is a simplified general representation of an x-ray source according to another embodiment of this invention.

FIG. 2 illustrates a simplified general representation of an x-ray source 120, according to another embodiment of this invention, for producing a uniformly intense area x-ray beam. The x-ray source 120 shown in FIG. 2 is similar to the x-ray source 20 shown in FIG. 1, except that the x-ray source 120 includes a differently shaped area electron emitter 122 and target material 124 from those shown in FIG. 1. The x-ray source 120 illustratively shown in FIG. 2 includes one area electron emitter 122 having a circularly shaped electron emitting surface 138 formed of a conductive material. The target material 124 includes a correspondingly shaped circular x-ray emitting surface 140 which is aligned with and spaced apart from the electron emitting surface 138. Similarly to the x-ray source illustrated in FIG. 1, the area electron emitter 122 and the target material 124 are disposed within a vacuum chamber 126, at or toward opposing ends thereof.

The x-ray source 120 includes an electric power source 130 electrically connected to the area electron emitter 122. The electric current from the electric power source 130 heats the area electron emitter 122 to cause a release of electrons toward the target material 124. The area electron emitter 122 is also electrically connected to a negative pole of a high voltage power source 132 for bias. The x-ray source 120 further includes a second high voltage power source 134 electrically connected by a positive pole to the target material 124.

Upon heating, such as, for example, by an electric current from the electric power source 130, the area electron emitter 122, which can be an area cathode, releases a spatially uniform field of electrons. The positive potential of the target material 124 strongly attracts the emitted electrons, causing the electrons to bombard the target material 124. Arrows 136 illustrate electron trajectories between the area electron emitter 122 and the target material 124. In one particularly preferred embodiment of this invention, the area electron emitter 122 includes a single dispenser cathode.

Figure 3:
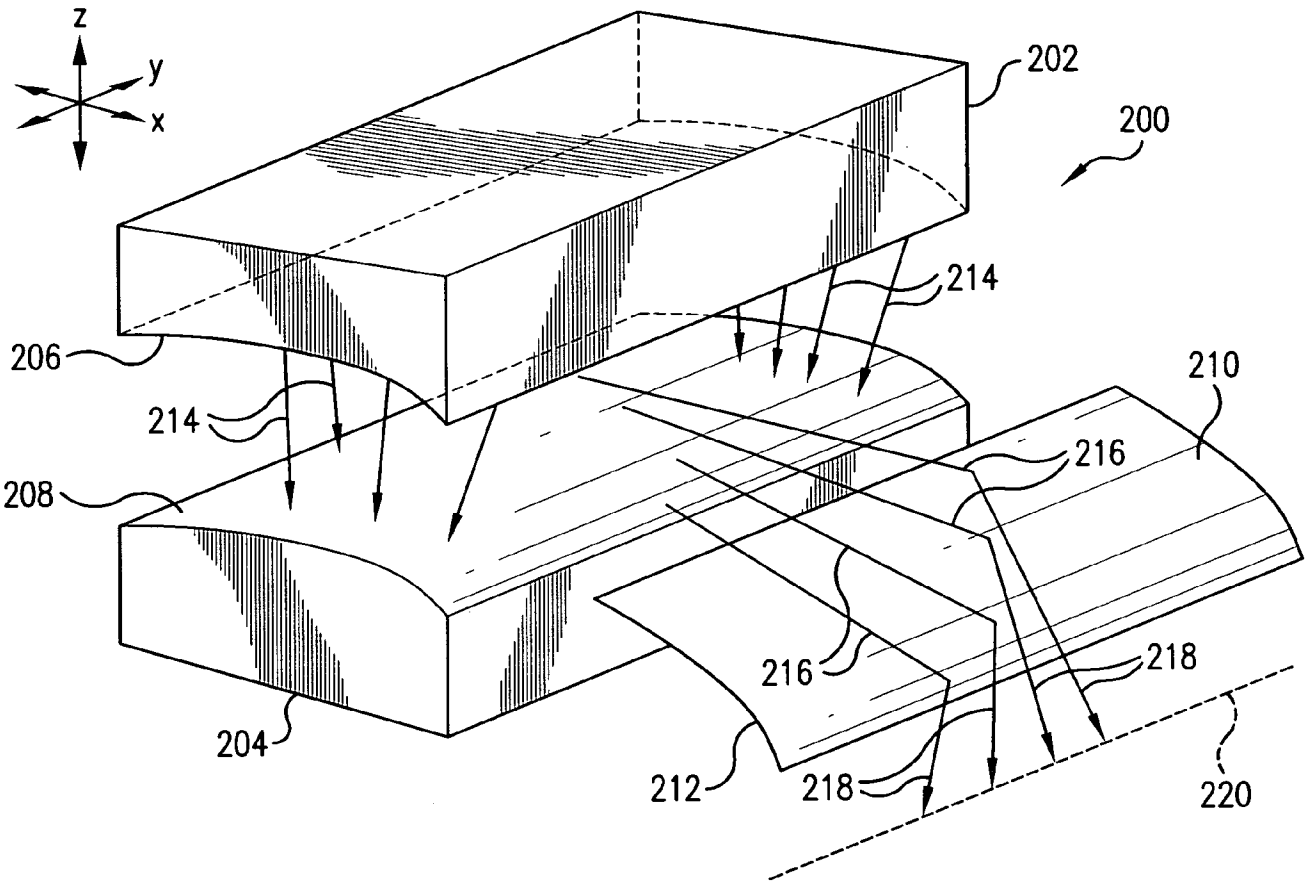
FIG. 3 is a simplified general representation of an x-ray source according to yet another embodiment of this invention in combination with a crystal monochromator.

In one embodiment of this invention, at least one of the area electron emitter and the target material is curved in at least one direction. FIG. 3 includes an illustration, simplified for explanatory purposes, of a curved area electron emitter and a curved target material of an x-ray source 200 for producing a uniformly intense area x-ray beam, according to one embodiment of this invention.

The x-ray source 200 includes a dispenser cathode 202 as an area electron emitter. The dispenser cathode 202 is aligned with and disposed apart from an anode 204 as the target material. As discussed above with reference to FIGS. 1 and 2, the dispenser cathode 202 and the anode 204 are desirably disposed within a vacuum chamber (not shown) and connected to opposite poles of at least one high voltage power source (not shown).

The dispenser cathode 202 is curved in that the dispenser cathode 202 has an electron emitting surface 206 that is curved. The electron emitting surface 206 is curved along a first axis, shown in FIG. 3 as the x-dimension, and linear, i.e., not curved, along a second axis, shown in FIG. 3 as the y-dimension. The shaped dispenser cathode 202 is concave or concavolinear, as the electron emitting surface 206 is concave in a first dimension, the x-dimension and linear in a second dimension, the y-dimension. As will be appreciated by one skilled in the art following the teachings herein provided, other curved shapes are available for the shaped area electron emitters or dispenser cathodes of the x-ray source of this invention, such as, for example, convex (i.e., convexolinear), concavoconcave, concavoconvex, and convexoconvex.

In one particularly preferred embodiment of this invention, as shown in FIG. 3, the anode 204 is a shaped anode including a curved x-ray emitting surface 208 that is correspondingly curved from the electron emitting surface 206 of the dispenser cathode 202. As used herein, references to "correspondingly curved" refer to a surface of a target material or anode having a curvature in a least one dimension determined by a Least-Squares fitting method or technique, as is known and available in the art, such that the electron emitting surface will provide a uniform emission of x-rays from the x-ray emitting surface. As shown in FIG. 3, the x-ray emitting surface 208 is convex, i.e., convexolinear, in that the x-ray emitting surface 208 is convex in the x-dimension and linear in the y-dimension, while the electron emitting surface 206, as discussed above is concave. In one embodiment of this invention, the radius of the convex x-ray emitting surface 208 of the anode 204 desirably is equal to, or substantially equal to, the radius of the correspondingly curved concave electron emitting surface 206 minus the distance between the anode 204 and cathode 206. The x-ray emitting surface 208 is aligned with and spaced apart from the correspondingly curved electron emitting surface 202 in a vacuum chamber (not shown) to provide a uniform electron impact distribution on the x-ray emitting surface 208 of the spatially uniform emission of electrons from the electron emitting surface 206. Other curved shapes are available for the shaped anode of the x-ray source of this invention include, for example, concave (i.e., concavolinear), concavoconcave, concavoconvex, and convexoconvex.

In the embodiment of this invention shown in FIG. 3, the anode 204 is a log spiral anode. The log spiral anode 204 includes a logarithmic spiral shaped or curved x-ray emitting surface 206. As used herein, references to a surface having a "logarithmic spiral shape" or "logarithmic spiral curve" refer to a surface that either precisely follows a logarithmic curve or that approaches or approximates a logarithmic curve in at least one dimension. As shown in FIG. 3, the x-ray emitting surface 206 is logarithmic spiral convex in the x-dimension. The electron emitting surface 206 of the shaped dispenser cathode 202 is, as is determined by, for example, a Least-Squares fitting method or technique to achieve spatial uniformity of x-ray emission, logarithmic spiral concave in the x-dimension to correspondingly match the x-ray emitting surface 206.

The spatially uniform, two-dimensional beam of x-rays produced by the x-ray source of this invention is particularly useful in combination with crystal optics, such as, for example, a crystal monochromator for delivering monochromatic x-rays to a sample, system, or specimen. As shown in FIG. 3, the x-ray source 200 is coupled with a crystal 210. The crystal 210 is shaped or curved to provide a surface 212 correspondingly shaped and/or curved to the x-ray emitting surface 206. The crystal 210 is a bent crystal having a logarithmic spiral shape. The crystal 210 can be various or alternative crystals known in the art, such as, for example, the crystal disclosed in U.S. Pat. No. 6,038,285, issued to Zhong et al., herein fully incorporated by reference in its entirety. In one embodiment of this invention, the crystal 210 is preferably constructed of silicon using a (3, 3, 3) lattice planes structure, and bent using a four bar bender, as disclosed in U.S. Pat. No. 6,038,285.

Upon heating by an electric current from an electric power source (not shown), the shaped dispenser cathode 202 releases a spatially uniform field of electrons. A positive charge of the shaped anode 204 strongly attracts the emitted electrons, causing the electrons to bombard the anode 204. Arrows 214 generally illustrate electron trajectories between the shaped dispenser cathode 202 and the shaped anode 204. The emitted electrons impact the shaped anode 204 in a uniform distribution to generate a uniformly intense area x-ray beam.

X-rays, illustrated by lines 216, are transmitted at and into the crystal 210. The highest density of x-ray beams generated from the shaped anode 204 will occur in a tangential or nearly tangential direction from the shaped anode 204. As used herein, the "take-off angle" is the angle measured between the x-ray emitting surface 206 and the tangential path in which the highest practical density of the x-rays is transmitted. As will be appreciated by one skilled in the art following the teachings in this specification, the drawings and in the claims, the take-off angle of the shaped anode 204 depends on the particular material forming the x-ray emitting surface 206 and the electron beam accelerating voltage, and thus the take-off angle is a calculable and measurable property of the system. For a particular material of the shaped anode 204, there is a take-off angle from the x-ray emitting surface 206 that optimizes the x-ray beam flux from the shaped anode 204. In one embodiment of this invention, such as shown in FIG. 3 including a logarithmic shaped x-ray emitting surface 206, the take-off angle is between about 5 degrees and about 7 degrees, and preferably about 6 degrees.

The bent crystal 210 is positioned with respect to the shaped x-ray emitting surface 206 for emitting convergent beams 218. In one embodiment of this invention, the bent crystal 210 is rocked in a plane of diffraction until monochromatic convergent beams 218 are emitted from the bent crystal 210. As will be appreciated by one skilled in the art following the teachings herein provided, a plurality of white beams 216 are transmitted through the bent crystal 210 and the monochromatic convergent beams 218 are separated from the white beams 216 by a fixed angle of diffraction.

The crystal 210 shown in FIG. 3 is shown in a Bragg type crystal diffraction mode of operation. In a Bragg crystal system, the divergent x-ray beams 216 enter the concave crystal surface 212 and are diffracted by the crystal back out through the concave crystal surface 212 as diffracted convergent beams 218. If there is no variation of the angle of incidence along the crystal surface 212, then the diffracted convergent beams 218 will be monochromatic beams. In one embodiment of this invention, the bent crystal 210 is positioned with respect to the take-off angle of the x-ray emitting surface 206 such that a maximum density of x-ray beams is transmitted into the crystal 210 and emitted as monochromatic convergent beams 218.

In the Bragg crystal system, such as shown in FIG. 3, the convergent beams 218 are diffracted toward, and intersect at, a real focal line 220. The monochromatic convergent beams 218 appear to emit from the focal line 220. In other words, the focal line 220 is the apparent source of monochromatic divergent beams (not shown). As will be appreciated by one skilled in the art following the teachings herein provided, the x-ray source of this invention can alternatively be used in combination with a Laue type crystal system. The Laue crystal provides a transmission geometry, as compared to the reflection geometry of the Bragg crystal. The Bragg crystal provides a real focus of the diffracted beams in the diffraction plane. The Laue crystal provides a virtual focus of the diffracted beams in the diffraction plane.

The crystal 210 produces a monochromatic beam 218 from the spatially uniform area x-ray beam emitted from the shaped anode 204. The monochromatic beam 218 can be beneficially used for radiography purposes. The monochromatic beams can be emitted through an object and then analyzed using, for example, a digital detector to produce an image of the object. The use of single-energy monochromatic x-rays simplifies the interpretation of data received during x-ray imaging systems. In the case of x-ray radiography, using monochromatic x-rays eliminates beam-hardening effects. The x-ray source of this invention is particularly useful in imaging methods generally known as diffraction enhanced imaging (DEI), such as, for example, the imaging methods disclosed in U.S. Pat. No. 5,987,095, issued 16 Nov. 1999 to Leroy Dean Chapman et al., and U.S. Pat. No. 6,577,708, issued 10 Jun. 2003 to Leroy Dean Chapman et al., each herein incorporated by reference in their entireties.

The invention further comprehends generating a uniformly intense area x-ray beam, and, more particularly, a uniformly intense area x-ray beam having any number of alternative predetermined geometries. In one embodiment of this invention, upon determining a desired geometry for the uniformly intense area x-ray beam, a target material is provided including at least one of a shape and a curve to produce the desired geometry for the uniformly intense area x-ray beam. An area electron emitter, having at least one of a corresponding shape and a corresponding curve, is positioned in a vacuum chamber opposite the shaped target material. Electrons are emitted from the area electron emitter toward the target material to impact the target material in a uniform distribution to generate a uniformly intense area x-ray beam.

In one embodiment of the invention, the target material and the area electron emitter, or at least one surface of each, have the same or identical shape. Possible shapes for both the target material and the area electron emitter include square, rectangular, cylindrical, oval, or polygonal. Possible curvatures for both the target material and the area electron emitter include concave, convex, concavoconcave, concavoconvex, and convexoconvex.

Figure 4:
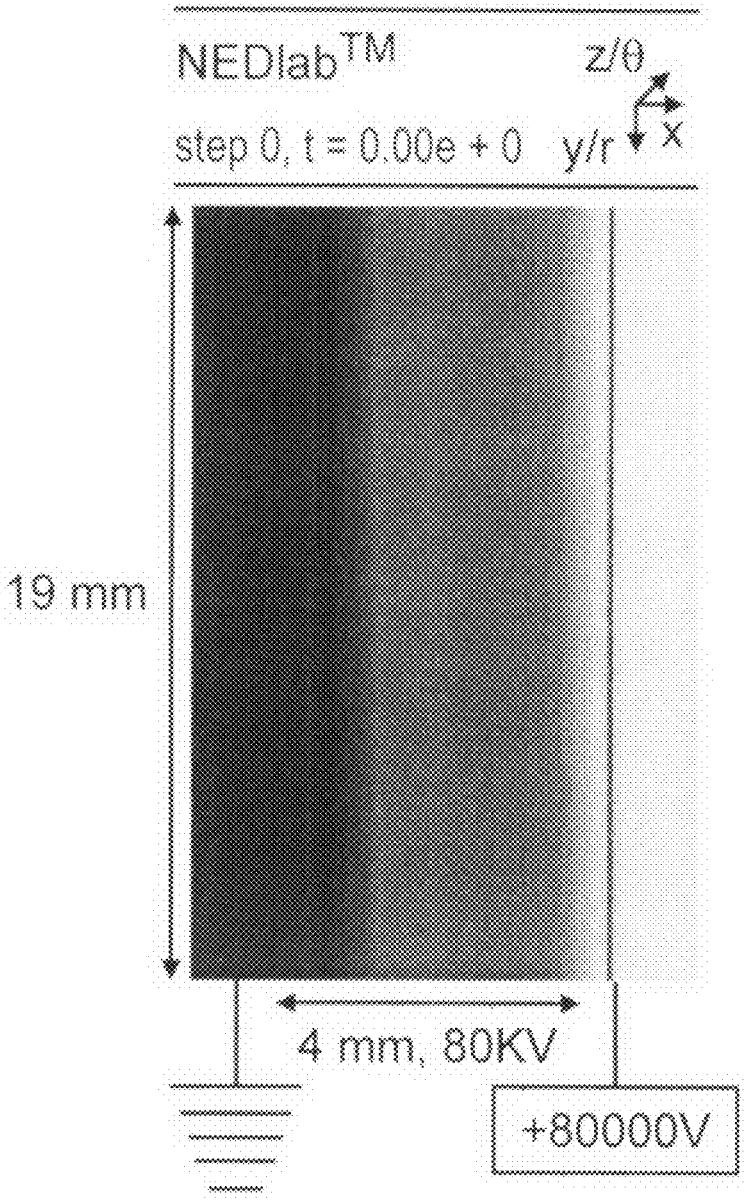
FIG. 4 is a computer simulation image showing a potential distribution between an area electron emitter and a target material according to one embodiment of this invention.

FIG. 4 is a computer simulation image showing a potential distribution between an area electron emitter and a target material according to one embodiment of this invention. The simulation image is a plot calculated using NEDlab™, available from AccelSoft Inc., Del Mar, Calif. The simulation image shows or represents a sectional view of an x-ray source with the area electron emitter on one side and the target material on the opposing side. The simulation image shows transverse (the vertical dimension in FIG. 4) uniformity of an electric field between the area electron emitter and the target material at 80 kV potential. The uniform field results in a uniform distribution of electron trajectories and impacts, thereby providing, as described above, a spatially uniform source of x-rays.

Thus the invention provides an x-ray source for producing a spatially uniformly intense source of x-rays. The x-ray source of this invention can include an appropriately correspondingly shaped and/or correspondingly curved area electron emitter and target material to provide a uniform x-ray beam of any of various and alternative beam geometries. The invention provides an extended two-dimensional, spatially uniform source of x-rays particularly suitable for use in x-ray imaging methods, such as, for example, known DEI imaging methods.

While the embodiments of the invention described herein are presently preferred, various modifications and improvements can be made without departing from the spirit and scope of the invention. The scope of the invention is indicated by the appended claims, and all changes that fall within the meaning and range of equivalents are intended to be embraced therein.

What is claimed is:

1. An x-ray source for producing a uniformly intense area x-ray beam, comprising:

a vacuum chamber;

an area electron emitter disposed at a first end of the vacuum chamber and including an electron emitting surface;

a target material disposed at a second end of the vacuum chamber and spaced apart from the area electron emitter, the target material including an x-ray emitting surface facing the electron emitting surface, wherein the target material is a shaped anode, the shaped anode being curved and one of concave, convex, concavoconcave, concavoconvex, and convexoconvex;

the electron emitting surface and the x-ray emitting surface are correspondingly curved; and at least one high voltage power source, the area electron emitter electrically connected to a negative pole of one of the at least one high voltage power source and the target electrically connected to a positive pole of one of the at least one high voltage power source.

2. The x-ray source according to claim 1, wherein the area electron emitter uniformly emits electrons along the electron emitting surface and the emitted electrons uniformly impact the x-ray emitting surface to produce the uniformly intense area x-ray beam.

3. The x-ray source according to claim 1, wherein the area electron emitter comprises a single cathode.

4. The x-ray source according to claim 1, wherein the area electron emitter comprises a dispenser cathode.

5. The x-ray source according to claim 1, wherein the area electron emitter is one of concave, convex, concavoconcave, concavoconvex, and convexoconvex.

6. The x-ray source according to claim 1, wherein the target material comprises a log spiral anode.

7. The x-ray source according to claim 1, wherein the target material comprises copper, silver, tungsten, or combinations thereof.

8. The x-ray source according to claim 1, wherein radii of the correspondingly curved electron and x-ray emitting surfaces are identical.

9. An x-ray source for producing a uniformly intense area x-ray beam, comprising:

a vacuum chamber;

a dispenser cathode disposed at a first end of the vacuum chamber and including an electron emitting surface;

an anode disposed at a second end of the vacuum chamber and spaced apart from the dispenser cathode, the anode including an x-ray emitting surface facing the electron emitting surface;

the electron emitting surface and the x-ray emitting surface being correspondingly curved to emit the uniformly intense area x-ray beam wherein the corresponding curves of the electron emitting surface of the dispenser cathode and the x-ray emitting surface of the anode are selected from a group including concave, convex, concavoconcave, concavoconvex, and convexoconvex; and at least one high voltage power source, the dispenser cathode electrically connected to a negative pole of one of the at least one high voltage power source and the anode electrically connected to a positive pole of one of the at least one high voltage power source.

10. The x-ray source according to claim 9, wherein the dispenser cathode uniformly emits electrons along the electron emitting surface and the emitted electrons uniformly impact the x-ray emitting surface to produce the uniformly intense area x-ray beam.

11. The x-ray source according to claim 9, wherein radii of the correspondingly curved electron and x-ray emitting surfaces are identical.

12. A method of generating a uniformly intense area x-ray beam, the method comprising:

determining a desired geometry for the uniformly intense area x-ray beam;

providing a target material including a curve to produce the desired geometry for the uniformly intense area x-ray beam;

matching to the shaped target material an area electron emitter having a corresponding curve, wherein the curve and the corresponding curve are selected from a group including concave, convex, concavoconcave, concavoconvex, and convexoconvex;

emitting electrons from the area electron emitter toward an x-ray emitting surface of the target material that is facing the area electron emitter; and impacting the x-ray emitting surface of the target material with the electrons in a uniform distribution to generate a uniformly intense area x-ray beam.

* * * * *